United States Patent [19]

Frankowski

[11] 4,262,059

[45] Apr. 14, 1981

[54] METHOD FOR MAKING A THIN-WALLED OBJECT

[76] Inventor: Leo A. Frankowski, 24770 Roosevelt Ct., Farmington Hills, Mich. 48018

[21] Appl. No.: 908,395

[22] Filed: May 22, 1978

[51] Int. Cl.[3] ..... B21D 28/10; B32B 3/24; B21D 28/26

[52] U.S. Cl. ..... 428/597; 29/527.4; 428/132; 428/134; 428/135; 428/136; 428/596

[58] Field of Search ..... 428/131-136, 428/596, 597; 29/527.4

[56] References Cited

U.S. PATENT DOCUMENTS

| | | | |
|---|---|---|---|
| 712,064 | 10/1902 | Heath | 428/132 |
| 854,927 | 5/1907 | Clark | 428/596 |
| 2,018,085 | 10/1935 | Otte | 428/596 |
| 2,192,573 | 3/1940 | Dunajeff | 428/596 |
| 2,457,616 | 12/1948 | Van Dyke et al. | 428/596 |
| 2,558,185 | 6/1951 | Leisen | 428/596 |
| 2,692,019 | 10/1954 | Zalkind | 428/596 |
| 2,800,423 | 7/1957 | deSwart | 428/136 |
| 3,282,657 | 11/1966 | Bright | 428/596 |
| 3,498,874 | 3/1970 | Evans et al. | 428/134 |
| 3,591,351 | 7/1971 | Ullman | 428/597 |
| 3,615,273 | 10/1971 | See | 428/596 |
| 3,655,501 | 4/1972 | Tesch | 428/136 |
| 3,852,870 | 12/1974 | Elliott | 428/596 |
| 3,869,778 | 3/1975 | Yancy | 428/596 |
| 4,038,040 | 7/1977 | Nagl | 428/596 |
| 4,170,122 | 10/1979 | Cowell | 428/596 |

FOREIGN PATENT DOCUMENTS

| | | | |
|---|---|---|---|
| 6357 | 3/1893 | Switzerland | 428/134 |

*Primary Examiner*—William R. Dixon, Jr.
*Attorney, Agent, or Firm*—Charles W. Chandler

[57] ABSTRACT

A method for forming a thin-walled object having a thin reinforcing sheet so perforated as to be deformable into a surface having a selected curvature, the reinforcing sheet being embedded in a plastic material that is hardened to form a surface corresponding to the curvature of the reinforcing sheet.

9 Claims, 8 Drawing Figures

METHOD FOR MAKING A THIN-WALLED OBJECT

BACKGROUND OF THE INVENTION

This invention is related to methods for making a thin-walled object having a continuous curved surface, and more particularly, to a method in which a plastic material is applied to a backing sheet of inflexible material deformed according to the curvature of the finished product, and then permitting the plastic material to harden.

There are a variety of applications in which it is desirable to form a thin-walled object having a curvilinear surface of a selected curvature. For example, fiberglass boats are made by applying a resin material to a fiberglass cloth or mat mounted on a support. Model cars are made in a similar manner, as well as model railroad track layouts and prototypes of vehicles. Typically, the forming process employs a fiberglass mat, cloth or screening as a reinforcement to support a plastic material applied to the mat until the material hardens. One limitation of such conventional procedures, is that the mat is so flexible as to be useful for only flat surfaces or for surfaces having a slight curvature. The mat is unsuitable for surfaces having a significant curvature because it is deformed as plastic material is applied to the mat surface.

SUMMARY OF THE INVENTION

The broad purpose of the present invention is to provide a novel method for making a thin-walled object by applying a coating of a plastic material to a deformable backing sheet having a selected curvature, and then permitting the plastic material to harden to assume the curvature of the backing sheet.

Another object of the invention is to provide a novel form of backing sheet in which selected portions of the backing sheet can be deformed in directions normal to the undeformed surface of the backing sheet.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
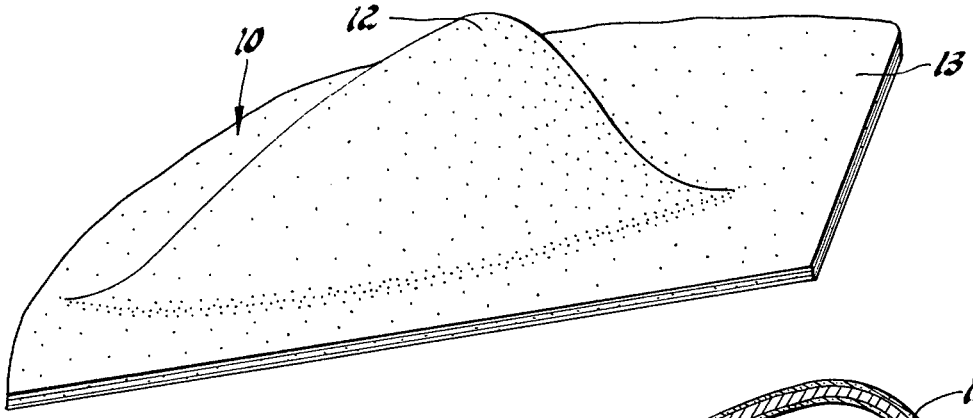
FIG. 1 is a perspective view showing a thin-walled object made in accordance with the preferred method.
Figure 2:
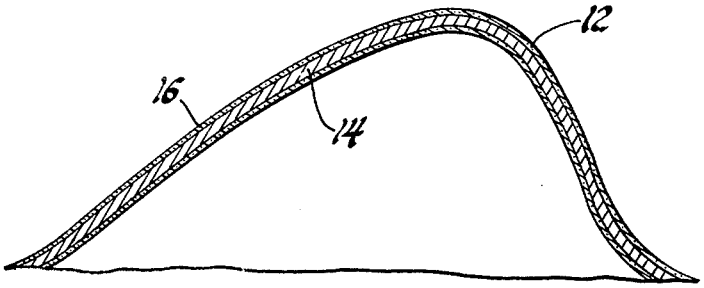
FIG. 2 is a sectional view through a portion of the object of FIG. 1.

Referring to the drawings, a thin-walled object 10 is illustrated in FIG. 1 as having a curved central portion 12 extending upwardly from a border 13 which is disposed essentially in a common plane about the central portion. Object 10 comprises a backing sheet 14 embedded in a hard surface material 16.

Preferably backing sheet 14 is formed of a thin gauge aluminum sheet perforated with a pattern of openings such that selected portions can be selectively deformed in a direction normal to the flat undeformed surface of the sheet. A typical pattern is illustrated as being contained within a rectangular section containing three openings 20, 22, and 24. These openings provide means for fastening sheet 14 to an appropriate support. An elongated top slit 26 has its ends connected to elongated side slits 28 and 30. Slit 28 is parallel to slit 30. A bottom slit 32 is parallel to the major portion of top slit 26 and extends closely adjacent to openings 20 and 24. An intermediate slit 34 is connected to bottom slit 32 and has its upper end closely adjacent to opening 22.

Three parallel elongated slits 36, 38, and 40 extend at an angle of 45° to both side slit 28, top slit 26, and bottom slit 32. Slit 36 is connected to slit 28. Slit 40 is connected to slit 26, and slit 38 is connected to the intersection of slits 34 and 32 such that the slits form a zig-zag section of metal between openings 20 and 22 with slits 36, 38, and 40 being substantially at 90° to an imaginary straight line connecting openings 20 and 22. The arrangement is such that sheet 14 adjacent opening 20 can be deformed in a direction at right angles to the plane of the undeformed sheet.

A slit 42, connected to top slit 26; a slit 44 parallel to slit 42 and connected to the intersection of slits 34 and 32; and a slit 46 which is parallel to slits 42 and 44 and connected to slit 30 cooperate to define a zig-zag strip of metal between openings 24 and 22. Slits 42, 44, and 46 are disposed at an angle of 45° with respect to slits 26 and 30 and also at an angle of 90° with respect to slits 36, 38, and 40. Thus a selected portion of the backing sheet contained between the areas bounded by slits 26, 28, 30, and 32 can be moved in a direction parallel, as well as at right angles to the surface of the undeformed backing sheet.

Figure 4:
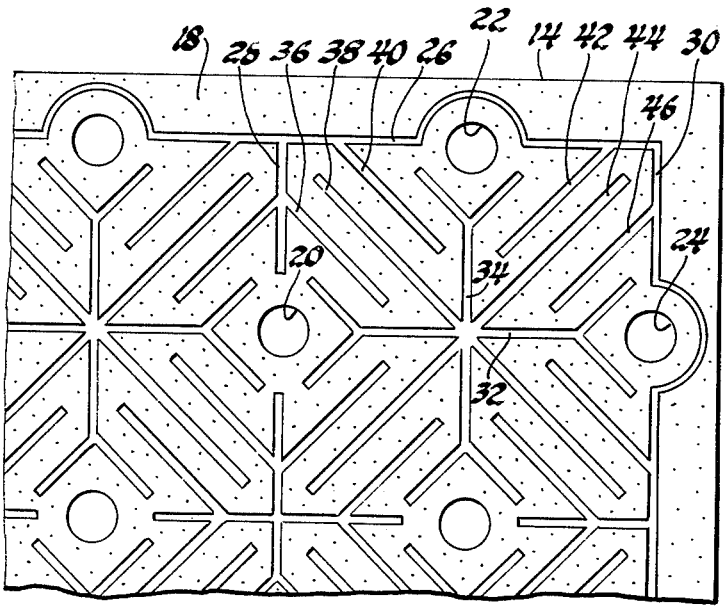
FIG. 4 is a fragmentary view showing a portion of a preferred backing sheet.

The pattern illustrated in FIG. 4 is repeated but in a reversed manner beneath slit 32, the total pattern being repeated a plurality of times over the surface of the sheet so that it forms a readily deformable sheet of inflexible material. The slits are arranged to maximize the metal path between adjacent openings thereby permitting a substantial deformation of metal in a limited area.

Backing sheet 14 is preferably formed by having the unperforated metal defined on a sheet of aluminum by a silk screen design and then etched by a solution of sodium hydroxide or an acid in the manner well known to those skilled in the art. Zinc, steel or other metals can be employed or even a plastic material that is non-flexible but deformable.

Figure 3:
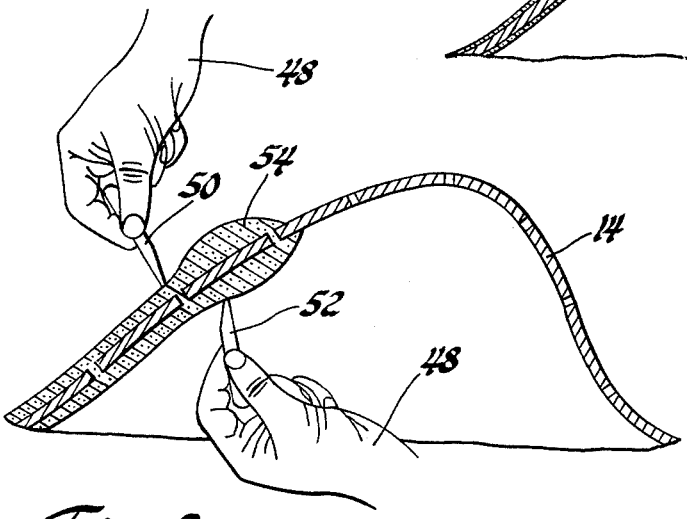
FIG. 3 is a view showing the manner in which a plastic material is applied to the backing sheet.

Referring to FIG. 3, backing sheet 14 is deformed to form a generally rounded configuration. The user 48 then employs tools 50 and 52 on opposite sides of sheet 14 to apply a plastic material 54, such as a polyester resin mixed with an appropriate hardener. Such a mixture, as is well known to those skilled in the art of automotive body repairs, is a plastic mixture that tends to harden after a few minutes. The user applies material 54 to form a coating that fills in the slits to form a continuous surface. When material 54 is hardened, the user can then sand smooth or otherwise treat the hardened surface as desired.

It is to be noted that because backing sheet 14 is readily deformable, but at the same time inflexible, the end product can have a substantial curvature defined by a relatively thin wall.

Backing sheet 14 can also be formed by wire, by punch pressing a sheet of metal, by a casting, a molding or an extrusion, as well as by an etching process. Other plastic materials can be employed such as an epoxy, paper mache, plaster or cement materials that can be applied in a plastic state and then hardened to form a continuous surface over the backing sheet.

Figure 5:
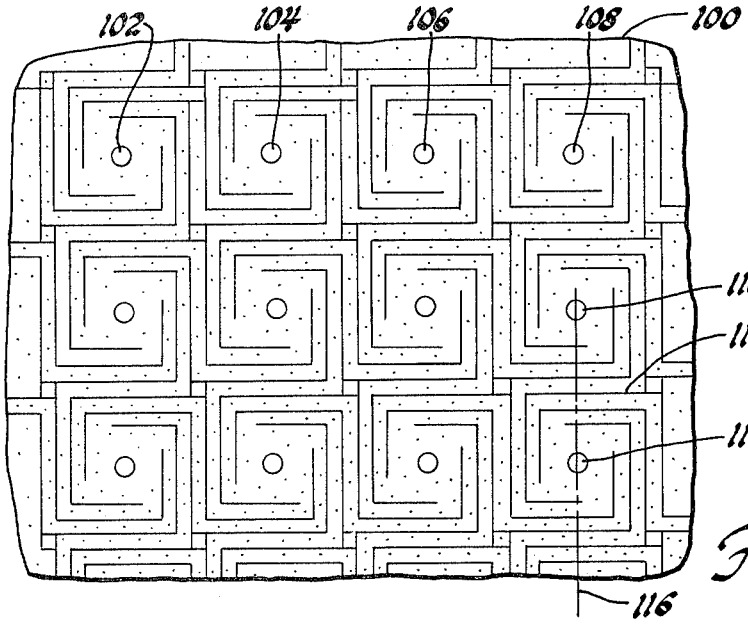
FIGS. 5–8 illustrate other preferred backing sheets employing different perforation patterns.

FIG. 5 illustrates a portion of a backing sheet 100 having a repeated pattern including four vertical rows of openings 102, 104, 106, and 108. Each row is spaced one inch from its adjacent rows, and the openings in each row are on one inch spacings. For purposes of illustration, openings 110 and 112 in row 108 are one inch apart, however, the spacing between rows and the spacing between openings in each row can be formed at any convenient distance. Sheet 100 has a pattern of slits 114 formed between the openings. Certain slits are at right angles to an imaginary straight line 116 drawn between openings 110 and 112, the other slits being parallel to such a straight line.

Each slit is cut completely through the sheet. It can be seen that a path can be tracked from opening 110 to opening 112 along an unslitted section of material. Similarly, a torturous path can be traced from slit 112 to its neighboring slits in row 106 along unslitted material in which a portion of the path is parallel to the imaginary line 116 and other portions of the path are perpendicular to such a line.

The user can fasten the sheet to a support by inserting fasteners through the openings, and then can move that portion of sheet material between the openings either perpendicular to the undeformed sheet or parallel to such a surface, to form a selected curvature.

Figure 6:
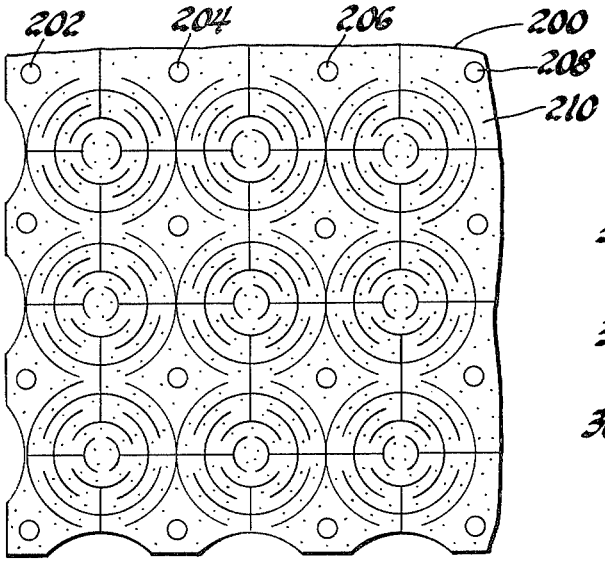

Each of the sheets illustrated in FIGS. 5, 6, 7, and 8 is formed of aluminum having slits cut with a die to form the illustrated patterns. FIG. 6 is the preferred die-cut pattern and illustrates backing sheet 200 having several vertical rows of openings 202, 204, 206, and 208. There is a one inch space between the rows and a one inch space between the openings in each row. A pattern of slits 210 is cut between the openings in which several of the slits are formed in a partially circular shape. A path can be traced through unslitted material from any opening in each row to a similar opening either in an adjacent row or in the same row. This also permits the user to form a selected portion of the backing sheet, to a selected curvature.

Figure 7:
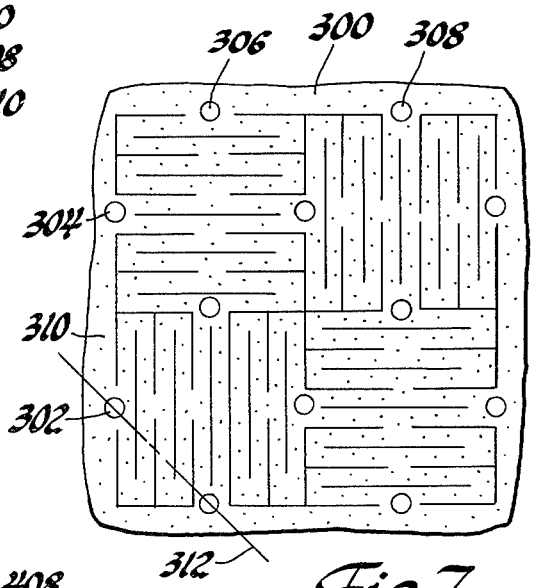

Similarly, FIG. 7 illustrates a backing sheet 300 having a plurality of linear, parallel rows of openings 302, 304, 306, and 308. The distance between the rows in the same as the distance between the individual openings in each row. Sheet 300 is also die cut with a pattern of slits 310 in which the individual slits in the pattern are cut at an angle of 45° with respect to an imaginary line 312 drawn between a pair of adjacent openings. As in the other embodiments, a path can be traced between adjacent openings along an unslitted section of material. The material between the openings can be moved in a direction at right angles to the undeformed surface of the sheet, as well as in a direction parallel to such a surface.

Figure 8:
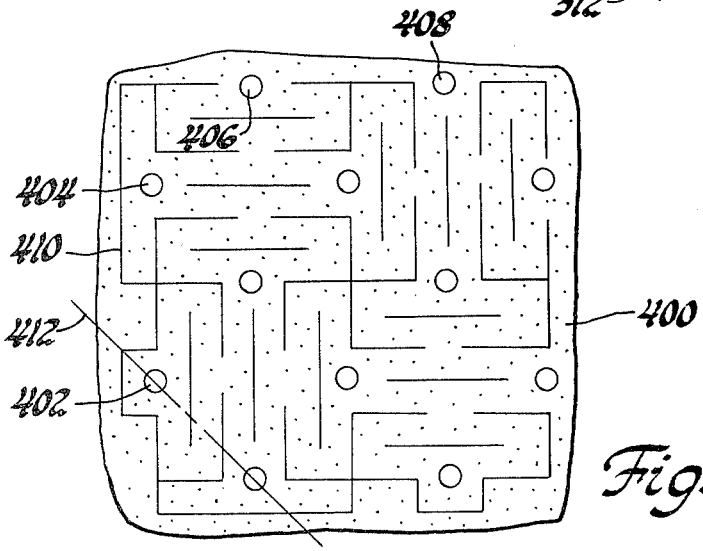

FIG. 8 illustrates another sheet 400 having linear rows of openings 402, 404, 406, and 408. Sheet 400 illustrates a pattern 400 in which the slits are linear and cut at an angle of about 45° with respect to an imaginary line 412 drawn between a pair of openings.

Having described my invention, I claim:

1. A deformable planar metal sheet having a pattern of equally spaced sections arranged in parallel rows, including a selected first section spaced from the edges of the sheet and a plurality of neighboring sections disposed about said first section, each of said sections being formed by a pattern of slits in the metal sheet defining a plurality of elements, each element of each section having one end connected to the other elements of the section, and an opposite end connected to a neighboring section such that the first section is movable in a direction perpendicular to the plane of the sheet in a motion independent of the motion of the neighboring sections.

2. A deformable metal sheet defined in claim 1, in which each section of said sheet is movable with respect to each of its neighboring sections in directions perpendicular to the plane of the sheet.

3. A deformable metal sheet as defined in claim 1 in which said elements have a generally zig zag configuration formed such that the sides of the slits defining each element of said first section are separated as said first section is moved with respect to said neighboring sections.

4. A deformable metal sheet as defined in claim 1, in which said slit means includes slits having a partially circular pattern.

5. A deformable metal sheet as defined in claim 1, in which said sheet has a pattern of slits as illustrated in FIG. 4.

6. A deformable metal sheet as defined in claim 1, in which said sheet has a pattern of slits as illustrated in FIG. 5.

7. A deformable metal sheet as defined in claim 1, in which said sheet has a pattern of slits as illustrated in FIG. 6.

8. A deformable metal sheet as defined in claim 1, in which said sheet has a pattern of slits as illustrated in FIG. 7.

9. A deformable metal sheet as defined in claim 1, in which said sheet has a pattern of slits as illustrated in FIG. 8.

* * * * *